US006741816B2

(12) United States Patent
Shim et al.

(10) Patent No.: US 6,741,816 B2
(45) Date of Patent: May 25, 2004

(54) TONE REPRODUCTION CURVE CONTROL METHOD

(75) Inventors: Woo-jung Shim, Suwon (KR); Min-seon Kim, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 110 days.

(21) Appl. No.: 10/214,940

(22) Filed: Aug. 9, 2002

(65) Prior Publication Data

US 2003/0086717 A1 May 8, 2003

(30) Foreign Application Priority Data

Aug. 11, 2001 (KR) ..... 2001-48522

(51) Int. Cl.[7] ..... G03G 15/00
(52) U.S. Cl. ..... 399/49; 399/27
(58) Field of Search ..... 399/27, 29, 49, 399/30

(56) References Cited

U.S. PATENT DOCUMENTS 5,436,705 A * 7/1995 Raj ..... 399/30
5,543,896 A * 8/1996 Mestha ..... 399/49
5,749,020 A * 5/1998 Mestha et al. ..... 399/49
5,749,021 A * 5/1998 Mestha et al. ..... 399/49
5,784,667 A * 7/1998 Mestha et al. ..... 399/49
5,960,232 A * 9/1999 Cheng ..... 399/55
6,035,152 A * 3/2000 Craig et al. ..... 399/49
6,201,936 B1 * 3/2001 Gross et al. ..... 399/49

* cited by examiner

*Primary Examiner*—Fred L. Braun
(74) *Attorney, Agent, or Firm*—Sughrue Mion, PLLC

(57) ABSTRACT

A toner reproduction curve (TRC) control method is provided. The TRC method for controlling a printer including a color toner density (CTD) sensor includes the steps of (a) measuring a development potential $V_B$, a charging potential $V_O$, an exposure potential $V_R$, and a development current Id and evaluating a development vector $V_D$, which is the difference between the development potential $V_B$ and the exposure potential $V_R$, and a backplating vector $V_{BP}$, which is the difference between the charging potential $V_O$ and the exposure potential $V_R$; (b) forming a TRC space using TRC data detected from the CTD sensor; (c) obtaining a TRC characteristic function from the TRC data, the development vector $V_D$=x, the backplating vector $V_{BP}$=y, and the development current Id=z; (d) forming an RTRC by setting TRC data, whose covariance is smaller than a threshold value among the detected TRC data, as RTRC data; and (e) measuring TRC data, comparing the measured TRC data with the RTRC data to calculate control parameter values, and controlling the printer using the control parameter values. The TRC method does not require other sensors but the CTD sensor. By using internal parameters covering environmental changes, the charging potential of a photosensitive body, a state of a developer, and the efficiency of a charger can be estimated, thereby realizing efficient TRC control.

25 Claims, 4 Drawing Sheets

TONE REPRODUCTION CURVE CONTROL METHOD

BACKGROUND OF THE INVENTION

1. Field of the Invention

The present invention relates to a method of controlling a printer, and more particularly, to an efficient tone reproduction curve (TRC) control method for providing images of high quality in response to environmental changes. The present application is based on Korean Patent Application No. 2001-48522, filed Aug. 11, 2001, which is incorporated herein by reference.

2. Description of the Related Art

A usual electrophotographic process applied in printers includes charging a photosensitive body with electricity, exposing the charged photosensitive body to form a latent image in a particular image area, adhering a developer to an area of the latent image on the charged photosensitive body using a developing device, transferring the developed image to a sheet, and fixing the image using a fusing roller.

In the charging process, the quality of the image can be increased by uniformly charging the photosensitive body with electricity. Accordingly, it is necessary to control the electric potential of the photosensitive body to be uniform during the charging. When the charging potential is low, contamination can occur in a non-image area. When the charging potential is high, developed mass per area (DMA) changes. When the charging potential is excessively high, the photosensitive body is permanently damaged.

Since the quality of an output image is related to the potential of a photosensitive body, it is necessary to maintain the potential of the photosensitive body within a predetermined range in order to obtain images of high quality. An electrostatic voltmeter (ESV) or an electrometer is used for measuring the potential of the photosensitive body. The ESV is disposed near the surface of a photoreceptor belt so that it can measure the potential of the photosensitive body when the photoreceptor belt passes an electrostatic electrode.

The potential of the photosensitive body is decreased to a predetermined potential referred to as an exposure potential to form the latent image during the exposure. The development device comes to have a development potential such that the potential of the developer is higher than the potential of a portion on which the latent image is formed, that is, the exposure potential, and lower than the potential of the other portion of the photoreceptor belt on which the latent image is not formed. As a result, the developer is made to adhere to an area of the latent image and thus development is performed.

The DMA of the developer during development is influenced not only by the charging potential, as described above, but also by the exposure potential and the development potential.

When the exposure potential is low, the difference between the exposure potential and the development potential is very big even if the development potential is maintained uniform. As a result, the amount of absorbed developer increases. When the exposure potential is high, the difference between the exposure potential and the development potential is small even if the development potential is maintained uniform. As a result, the amount of absorbed developer decreases, thereby producing a blurred image.

Similarly, under the condition that a constant charging potential and a constant exposure potential are applied to the photosensitive body, when a development potential applied to the photosensitive body is very high, the small difference between the development potential and the exposure potential causes the developer to be excessively absorbed. In contrast, when a development potential applied to the photosensitive body is very low, the big difference between the development potential and the exposure potential causes the developer to be poorly absorbed, thereby blurring an image.

FIG. 1 shows a method of controlling DMA to correct development errors in order to obtain an image of high quality, which is disclosed in U.S. Pat. No. 5,749,021. According to the method, the charging potential, exposure potential, and development potential are controlled based on internal process parameters known as a discharge ratio, a cleaning potential and a development potential.

This conventional method increases the quality of a printed image by controlling DMA in a process control loop. An area in which an image is formed is referred to as an image area. A test patch is usually provided between image areas to measure DMA. The measured DMA is compared with a target value, an error signal is transmitted to a controller, and the internal process parameters are adjusted, thereby correcting errors. In other words, a grid potential and an average beam power of an exposure system are calculated using the internal processes parameters to control the system of a printer.

Referring to FIG. 1, a level 1 controller 120 provides suitable control signals $U_g$ and $U_l$ to an electrostatic charging and exposure system 122 to control the electrostatic charging and exposure system 122. Reference numeral 124 denotes a charging potential value $V_h$ and an exposure potential value $V_l$ of the electrostatic charging and exposure system 122, which are measured by an ESV. Comparators 126*a* and 126*b* compare the values $V_h$ and $V_l$ with target values $V_h^T$ and $V_l^T$ denoted by reference numeral 128 for a charging potential and an exposure potential, respectively, and transmit error signals $E_h$ and $E_l$, respectively, denoted by reference numeral 129 to the level 1 controller 120. The gain of a level 1 loop is obtained from the error signals such that the potentials of a photosensitive body can converge to target values within a predetermined range.

The target values $V_h^T$ and $V_l^T$ for the charging potential and exposure potential provided to the level 1controller 120 and the electrostatic charging and exposure system 122 are generated from a level 2 controller 130. Comparators 136*a*, 136*b*, and 136*c* compare DMA sensor values $D_l$, $D_m$, and $D_h$ denoted by reference numeral 134, which are measured from test patches provided according to a toner area coverage in a color toner density (CTD) sensor, with target values $D_l^T$, $D_m^T$, and $D_h^T$ denoted by reference numeral 138, respectively, and transmit error signals 139 to the level 2 controller 130. In addition, the level 2 controller 130 generates a signal $V^T_d$ for controlling a development system 132.

In other words, in the conventional DMA control method, DMA values measured by a CTD sensor are compared with target DMA values to generate differences therebetween. The differences are transmitted to a level 2 controller. The level 2 controller linearizes internal process parameters, i.e., a discharge ratio, a cleaning potential, and a development potential and extracts target values for control parameters, i.e., a charging potential, an exposure potential, and a development potential, from the linearized discharge ratio, cleaning potential and development potential to control a level 1controller and charging, exposure, and development systems.

The conventional DMA control method disclosed in U.S. Pat. No. 5,749,021 uses not only a CTD sensor but also an electrostatic sensor in order to diagnose the status of all parameters influencing an electrophotographic process, which complicate measurement. In addition, the conventional DMA control method is not adaptive in a state in which a charging, exposure, or development system changes due to changes in external environmental parameters such as temperature and humidity of a printer, or due to internal environmental changes such as replacement or supplement of substances such as a developer or a photosensitive body included in the printer. Moreover, the conventional DMA control method has a disadvantage of individually linearizing a discharge ratio, a cleaning potential, and a development potential in order to control a charging potential, an exposure potential, and a development potential based on internal process parameters, i.e., a discharge ratio, a cleaning potential, and a development potential.

SUMMARY OF THE INVENTION

To solve the above-described problems, it is a first object of the present invention to provide a toner reproduction curve (TRC) control method for providing an image of high quality in response to external and internal environmental changes.

It is a second object of the present invention to provide a simple TRC control method for diagnosing the state of a printer.

To achieve one of more objects of the invention, there is provided a method of controlling a TRC in a printer including a color toner density (CTD) sensor receiving light reflected from test patches having different densities and photoelectrically converting the received light, the test patches being provided on a photoreceptor belt. The method includes the steps of (a) measuring a development potential $V_B$, a charging potential $V_O$, an exposure potential $V_R$, and a development current Id and evaluating a development vector $V_D$, which is the difference between the development potential $V_B$ and the exposure potential $V_R$, and a backplating vector $V_{BP}$, which is the difference between the charging potential $V_O$ and the exposure potential $V_R$; (b) forming a TRC space using TRC data detected from the CTD sensor; (c) obtaining a TRC characteristic function from the TRC data, the development vector $V_D$=x, the backplating vector $V_B$P=y, and the development current Id=z; (d) forming an RTRC by setting TRC data, whose covariance is smaller than a threshold value among the detected TRC data, as RTRC data; and (e) measuring TRC data, comparing the measured TRC data with the RTRC data to calculate control parameter values, and controlling the printer using the control parameter values.

The step (a) includes the steps of (a-1) measuring a development potential $V_B$, a charging potential $V_O$, an exposure potential $V_R$, and a development current Id; and (a-2) evaluating a development vector $V_D$ and a backplating vector $V_{BP}$ from the measured development potential $V_B$, charging potential $V_O$ and exposure potential $V_R$. The development vector $V_D$ and the backplating vector $V_{BP}$ satisfy the following formulae.

$$V_D=V_B-V_R \quad (1)$$

$$V_{BP}=V_O-V_B \quad (2)$$

The step (b) includes the steps of (b-1) developing a test patch at a high toner area coverage, a test patch at a mid toner area coverage, and a test patch at a low toner area coverage on the photoreceptor belt and detecting a signal $T_H$ corresponding to the high toner area coverage, a signal $T_M$ corresponding to the mid toner area coverage, and a signal $T_L$ corresponding to the low toner area coverage from the CTD sensor receiving infrared rays reflected from the test patches and generating electrical signals; and (b-2) forming a TRC space using the detected signals $T_H$, $T_M$, and $T_L$.

The step (c) includes the steps of (c-1) obtaining a non-linear equation satisfying KV−T=0; (c-2) obtaining a Jacobian matrix J of the non-linear equation; (c-3) deducing the values of x, y, and z by combining an equation obtained from the Jacobian matrix J and the non-linear equation with the detected TRC($T_H$, $T_M$, $T_L$) data.

The step (d) includes the steps of (d-1) deducing a development vector $V_D$, a backplating vector $V_{BP}$, and a development current Id by combining the TRC($T_H$, $T_M$, $T_L$) data detected in step (b-1) with the TRC characteristic function obtained in step (c); (d-2) forming an RTRC($T_{RH}$, $T_{RM}$, $T_{RL}$) space using TRC($T_H$, $T_M$, $T_L$) data, whose covariance is smaller than the threshold value, among the TRC ($T_H$, $T_M$, $T_L$) data detected in step (b-1); and (d-3) determining a function having the development current Id as an independent parameter and the development vector $V_D$ as a dependent parameter and a function having the development current Id as an independent parameter and the backplating vector $V_{BP}$ as a dependent parameter by curve fitting the development vector $V_D$, the backplating vector $V_{BP}$, and the development current Id to be suitable to the RTRC($T_{RH}$, $T_{RM}$, $T_{RL}$) space formed in step (d-2).

The step (e) includes the steps of (e-1) measuring TRC ($T_H$, $T_M$, $T_L$) data in real time; (e-2) comparing the measured TRC($T_H$, $T_M$, $T_L$) data with RTRC($T_{RH}$, $T_{RM}$, $T_{RL}$) data; (e-3) calculating a development vector $V_D$ and a backplating vector $V_{BP}$ with respect to the measured development current Id from the TRC characteristic function obtained in step (c), when the deviation between the measured TRC($T_H$, $T_M$, $T_L$) data and the RTRC($T_{RH}$, $T_{RM}$, $T_{RL}$) data is greater than a tolerance error; (e-4) calculating a new development vector $V_D$' and a new backplating vector $V_{BP}$' by combining the measured development current Id with the functions of the development vector $V_D$ and the backplating vector $V_{BP}$ obtained in step (d-3); (e-5) calculating a value of a grid potential $V_G$ and a value of a development potential $V_B$ as the control parameter values using the new development vector $V_D$' and the new backplating vector $V_{BP}$' calculated in step (e-4); and (e-6) controlling the charging potential $V_O$, exposure potential $V_R$ and development current Id of the printer by applying the value of a grid potential $V_G$ and the value of a development potential $V_B$ to the printer.

Preferably, the step (e) further includes the step of (e-7) estimating the efficiency of a charger from the development vector $V_D$ and the backplating vector $V_{BP}$ which are calculated in step (e-3) and from a development potential $V_B$ and a grid potential $V_G$ which are measured.

The present invention controls a grid potential and a development potential by deducing the potentials (charging potential, exposure potential, and development potential) and development current of a photosensitive body which are necessary for maintaining and controlling the TRC of an apparatus such as an electrophotographic printer or a copy machine which uses an electrophotographic process.

Particularly, the potentials (charging potential, exposure potential, and development potential) of a photosensitive body are deduced using TRC data measured by a CTD sensor, without using an electrostatic sensor for measuring the charging potential and exposure potential of the photosensitive body and a sensor for measuring the development current. Here, internal process parameters are a development vector, a backplating vector, and a development current which are defined above. A target RTRC value is set based on the result of deduction so that the TRC can approximate an RTRC to maintain or control the TRC.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
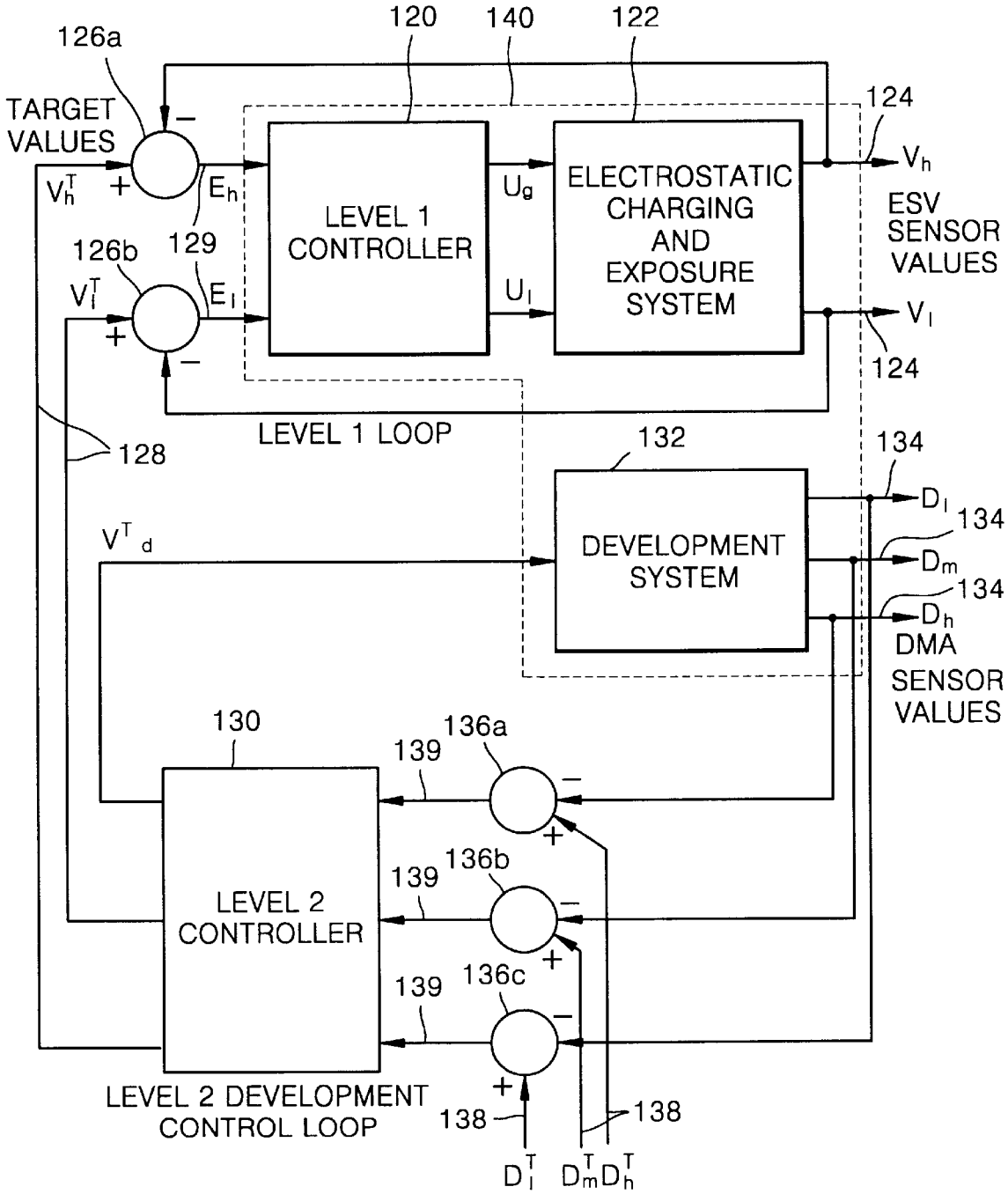
FIG. 1 (PRIOR ART)
FIG. 1 is a diagram of a conventional system for controlling developed mass per area (DMA) to control image errors.
Figure 2:
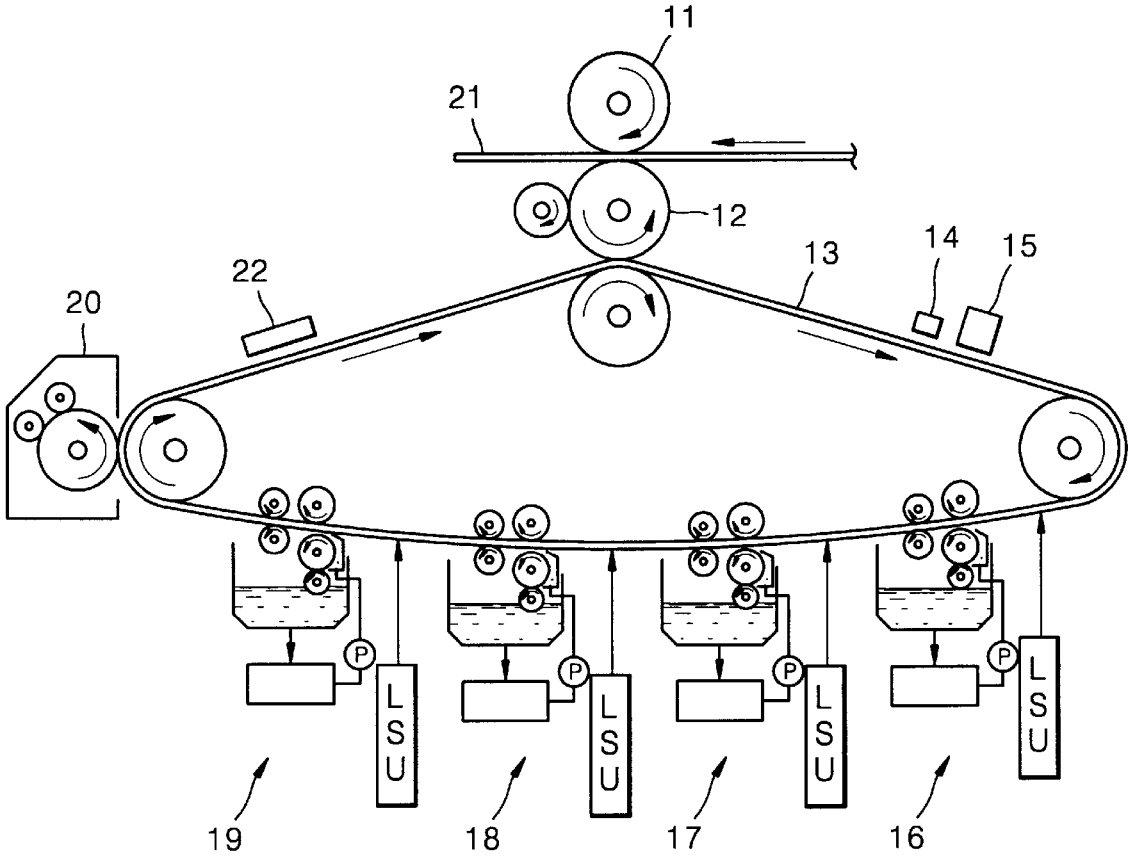
FIG. 2 is a schematic diagram of a printer to which a toner reproduction curve (TRC) control method according the present invention is applied.

Hereinafter, a toner reproduction curve (TRC) control method according the present invention will be described in detail with reference to the attached drawings. FIG. 2 shows a printer to which the present invention is applied. The printer of FIG. 2 uses a typical electrophotographic process.

Referring to FIG. 2, the printer includes a charging unit 15 for charging the photosensitive body of a photoreceptor belt 13; development units 16, 17, 18, and 19 which include a laser scanning unit (LSU) for exposing the charged photosensitive body to form a latent image and which adhere developers of different colors, i.e., yellow, cyan, magenta, and black, to the exposed portion of the photosensitive body to develop the image; a dry unit 20 for removing a carrier from the developed portion; a color toner density (CTD) sensor 22 for radiating infrared rays onto a developed test patch on the photoreceptor belt 13, measuring the intensity of reflected light, and generating an electric signal corresponding to developed mass per area (DMA); a first transfer unit for transferring the image developed on the photoreceptor belt 13 to a medium transfer roller 12 contacting the photoreceptor belt 13; a second transfer unit including a fusing roller 11 and the medium transfer roller 12 for transferring the image on the medium transfer roller 12 to a sheet 21; and a discharger 14 for lowering the potential of the photosensitive body after the transfer and maintaining the potential constant.

A TRC is a graph of each of signals $T_H$, $T_M$, and $T_L$ detected by the CTD sensor 22 at each toner area coverage.

Figure 3:
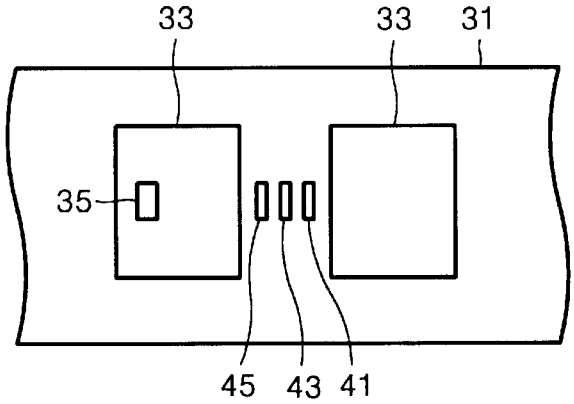
FIG. 3 is a schematic diagram of a photoreceptor belt to which a TRC control method according the present invention is applied.

FIG. 3 is a diagram of a portion of a photoreceptor belt where a CTD sensor is located to measure the TRC of a test patch. Referring to FIG. 3, two image areas 33 are separated from each other on a photoreceptor belt 31, and test patches 41, 43, and 45 are provided between the two image areas 33. According to a toner area coverage, the test patches 41, 43, and 45 are divided into the test patch 41 at a high area coverage of 90–100%, the test patch 43 at a mid area coverage of around 50%, and the test patch 45 at a low area coverage of 0–20%. A CTD sensor 22 is provided to be separated from the photoreceptor belt 31 by a predetermined distance. The CTD sensor 22 radiates infrared rays onto the test patches 41, 43, and 45 and measures the intensity of reflected light. Among signals detected by the CTD sensor 22, a signal detected from the test patch 41 at high area coverage is referred to as $T_H$, a signal detected from the test patch 43 at mid area coverage is referred to as $T_M$, and a signal detected from the test patch 45 at low area coverage is referred to as $T_L$.

The actual density of a developer printed on each of the test patches 41, 43, and 45 can be optically measured using the CTD sensor 22. As the density of a developer on the test patches 41, 43, and 45 gets higher, more light is absorbed into the test patches 41, 43, and 45. Accordingly, the test patches 41, 43, and 45 sensed by an optical sensor appear darker.

As described above, since the CTD sensor 22 measures the quantity of light reflected from each of the test patches 41, 43, and 45 and generates an electric signal corresponding to the quantity of light, as the density of a developer, that is, a toner area coverage, on each test patch 41, 43, or 45 increases, the amplitude of the generated electric signal also increases. Accordingly, Formula (3) can be accomplished.

$$T_H > T_M > T_L \tag{3}$$

Figure 4:
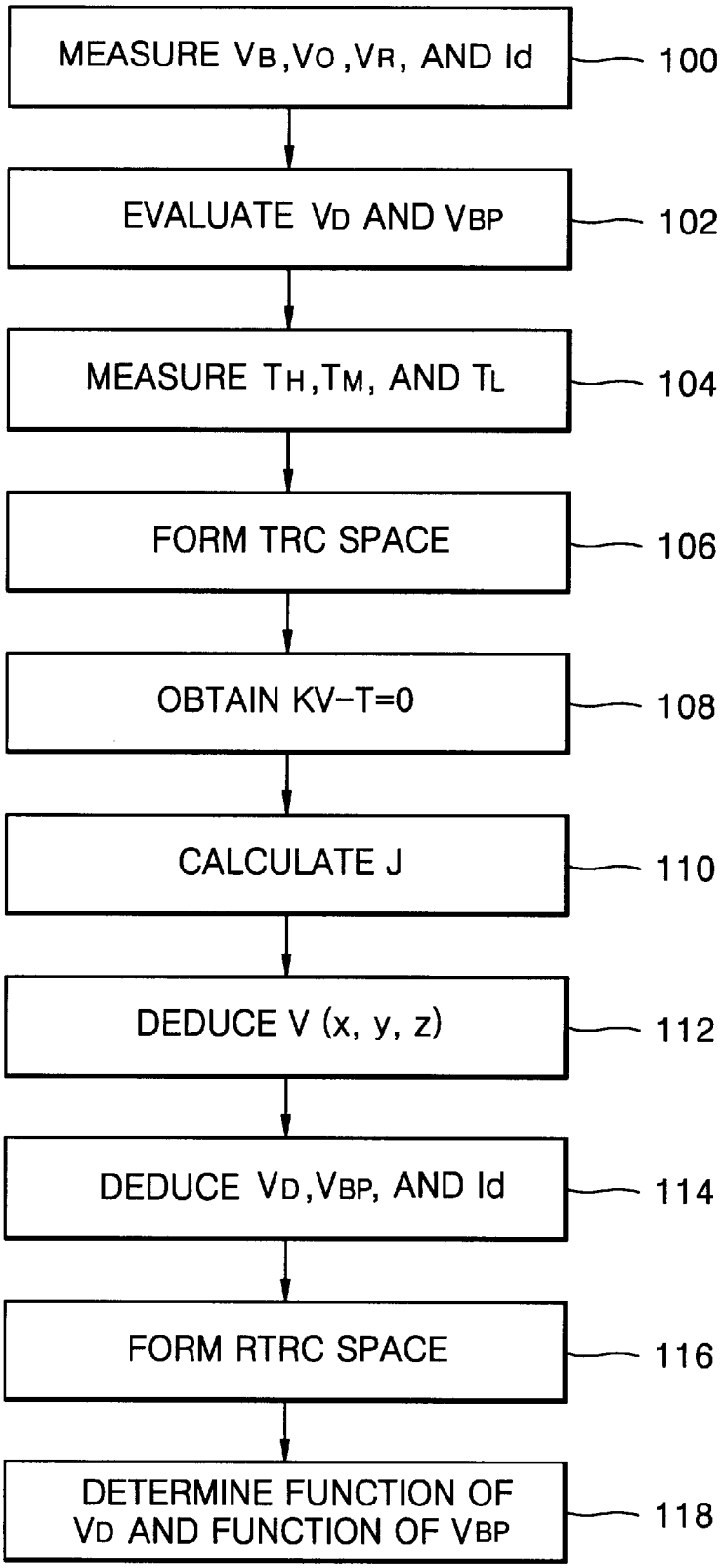
FIG. 4 is a flowchart of a TRC control method according to an embodiment of the present invention.

FIG. 4 is a flowchart of the algorithm of a TRC control method according to an embodiment of the present invention. In order to obtain an efficient TRC control algorithm, changes in external environments, such as temperature and humidity which causes the characteristics of a developer or a photoreceptor belt to change, and internal environmental changes, such as replacement and supplement of the developer and replacement of the photoreceptor belt, should be considered. Here, mass per area (M/A) can be expressed by Formula (4).

$$M/A = F(\text{tone}, V_B, V_G, P_{LD}, V_{OPR}, V_{RES}, \text{Id}, \sigma, \%S, T, RH, \ldots) \tag{4}$$

Here, tone denotes a toner area coverage, $P_{LD}$ denotes a laser beam power, $V_{OPR}$ denotes the charging potential of a photoreceptor belt, $V_{RES}$ denotes the discharging potential of the photoreceptor belt, $\sigma$ denotes the conductivity of a developer, T denotes temperature, and RH denotes relative humidity.

When environments such as temperature and humidity change in Formula (4), uncontrollable parameters may be generated, and interaction may occur between some independent parameters. Even when such unexpected parameters are considered, external and internal environmental changes result in changes in the development current of the developer and changes in the potentials (the development potential $V_B$, charging potential $V_O$, and exposure potential $V_R$) of the photoreceptor belt, which results in changes in a development vector $V_D$, a backplating vector $V_{BP}$, and development current Id. Here, as time and environments change, the conductivity of the developer increases, and escape of ions increases, so it is assumed that the development current of the developer changes.

In the present invention, for the above reasons, the development vector $V_D$, the backplating vector $V_{BP}$, and the development current Id are set as internal process parameters. Here, the M/A in Formula (4) can be simplified as in Formula (5).

$$M/A = G(V_D, V_{BP}, \text{Id}, \text{tone}) \tag{5}$$

In Formula (5), it is assumed that there is no interaction between independent parameters, and different combinations of independent parameters have different M/A values. Here, since the TRC output, TRC (tone), measured by a CTD sensor is proportional to the M/A, it can be expressed by Formula (6).

$$\text{TRC (tone)}=H\ (V_D,\ V_{BP},\ \text{Id, tone}) \tag{6}$$

Here, a TRC characteristic equation can be obtained from tests. The following steps (a), (b), and (c) must be performed to obtain the TRC characteristic equation.

Step (a) includes steps 100 and 102. In step 100, the development potential $V_B$, charging potential $V_O$, exposure potential $V_R$, and development current Id are measured. In step 102, Formulae (1) and (2) are applied to the measured development potential $V_B$, charging potential $V_O$, and exposure potential $V_R$ to evaluate the development vector $V_D$ and backplating vector $V_{BP}$.

Step (b) includes steps 104 and 106. In step 104, $T_H$, $T_M$, and $T_L$ are measured. The values of the development vector $V_D$ and backplating vector $V_{BP}$ evaluated in step 102 and the values of $T_H$, $T_M$, and $T_L$ measured in step 104 are shown in the following table. In step 106, a TRC space is formed using the values of $T_H$, $T_M$, and $T_L$. When levels for the above four parameters were set to 4, 3, 3, and 3, respectively, and an output level was set to 3 in a test for obtaining the TRC characteristic equation, the following table was obtained.

| $V_D$ | $V_{BP}$ | Id | TRC | | |
|---|---|---|---|---|---|
| X | y | z | $T_L$ | $T_M$ | $T_H$ |
| 184 | 290 | 200 | 3.031 | 4.035 | 5.699 |
| 214 | 260 | 200 | 3.006 | 4.383 | 5.682 |
| 244 | 230 | 200 | 2.811 | 4.447 | 5.699 |
| 274 | 200 | 200 | 2.963 | 4.530 | 5.765 |
| 197 | 260 | 200 | 3.018 | 4.259 | 5.511 |
| 227 | 230 | 200 | 3.160 | 4.369 | 5.507 |
| 257 | 200 | 200 | 3.397 | 4.435 | 5.577 |
| 287 | 170 | 200 | 3.463 | 4.611 | 5.575 |
| 208 | 230 | 200 | 3.324 | 4.225 | 5.534 |
| 238 | 200 | 200 | 3.329 | 4.323 | 5.502 |
| 268 | 170 | 200 | 3.471 | 4.508 | 5.578 |
| 298 | 140 | 200 | 3.518 | 4.714 | 5.605 |
| 184 | 290 | 264 | 2.342 | 4.325 | 5.607 |
| 214 | 260 | 264 | 2.340 | 4.300 | 5.672 |
| 244 | 230 | 264 | 2.828 | 4.427 | 5.690 |
| 274 | 200 | 264 | 2.584 | 4.410 | 5.787 |
| 197 | 260 | 264 | 2.320 | 4.256 | 5.536 |
| 227 | 230 | 264 | 2.472 | 4.386 | 5.607 |
| 257 | 200 | 264 | 2.689 | 4.566 | 5.663 |
| 287 | 170 | 264 | 2.467 | 4.796 | 5.807 |
| 208 | 230 | 264 | 2.987 | 4.483 | 5.531 |
| 238 | 200 | 264 | 2.889 | 4.493 | 5.589 |
| 268 | 170 | 264 | 2.701 | 4.593 | 5.668 |
| 298 | 140 | 264 | 3.136 | 4.811 | 5.748 |
| 184 | 290 | 324 | 2.457 | 4.362 | 5.336 |
| 214 | 260 | 324 | 2.709 | 4.486 | 5.536 |
| 244 | 230 | 324 | 2.511 | 4.755 | 5.467 |
| 274 | 200 | 324 | 2.836 | 4.857 | 5.668 |
| 197 | 260 | 324 | 2.704 | 4.388 | 5.424 |
| 227 | 230 | 324 | 2.572 | 4.598 | 5.514 |
| 257 | 200 | 324 | 2.762 | 4.713 | 5.568 |
| 287 | 170 | 324 | 2.884 | 4.857 | 5.660 |
| 208 | 230 | 324 | 2.784 | 4.395 | 5.394 |
| 238 | 200 | 324 | 2.709 | 4.642 | 5.441 |
| 268 | 170 | 324 | 3.009 | 4.686 | 5.557 |
| 298 | 140 | 324 | 3.087 | 4.911 | 5.636 |

In the test, toner area coverages on test patches are set to a low area coverage of 20%, a mid area coverage of 50%, and a high area coverage of 80%. Here, the TRC (tone) in Formula (6) can be expressed by Formula (7) with respect to signals $T_H$, $T_M$, and $T_L$ detected at the respective toner area coverages.

$$\begin{aligned} T_L &= H_L\ (V_D,\ V_{BP},\ \text{Id, tone}) \\ T_M &= H_M\ (V_D,\ V_{BP},\ \text{Id, tone}) \\ T_H &= H_H\ (V_D,\ V_{BP},\ \text{Id, tone}) \end{aligned} \tag{7}$$

When $V_D$, $V_{BP}$, and Id are represented by x, y, and z, respectively, the ted signals $T_H$, $T_M$, and $T_L$ depending on a toner area coverage in the can be expressed by Formula (8).

$$\begin{bmatrix} T_L \\ T_M \\ T_H \end{bmatrix} = \begin{bmatrix} A_L \\ A_M \\ A_H \end{bmatrix} x^2 + \begin{bmatrix} B_L \\ B_M \\ B_H \end{bmatrix} y^2 + \begin{bmatrix} C_L \\ C_M \\ C_H \end{bmatrix} z^2 + \begin{bmatrix} D_L \\ D_M \\ D_H \end{bmatrix} xy + \begin{bmatrix} E_L \\ E_M \\ E_H \end{bmatrix} yz + \begin{bmatrix} F_L \\ F_M \\ F_H \end{bmatrix} zx + \begin{bmatrix} G_L \\ G_M \\ G_H \end{bmatrix} \tag{8}$$

In Formula (8), coefficients $A_N$, $B_N$, $C_N$, $D_N$, $E_N$, $F_N$, and $G_N$ (N=L, M, and H) can be obtained by performing curve fitting using the result of the test.

In step (c), a TRC characteristic function is T=KV, as shown in Formula (8), and satisfies Formula (9).

$$T = \begin{bmatrix} T_L \\ T_M \\ T_H \end{bmatrix} \tag{9}$$

$$K = \begin{bmatrix} A_L & B_L & C_L & D_L & E_L & F_L & G_L \\ A_M & B_M & C_M & D_M & E_M & F_M & G_M \\ A_H & B_H & C_H & D_H & E_H & F_H & G_H \end{bmatrix}$$

$$V = \begin{bmatrix} x^2 \\ y^2 \\ z^2 \\ xy \\ yz \\ zx \\ 1 \end{bmatrix}$$

$$x = V_D,\ y = V_{BP},\ z = Id$$

Curve fitting was performed using the data of the above test table and the following coefficients were obtained for $A_N$, $B_N$, $C_N$, $D_N$, $E_N$, $F_N$, and $G_N$ (N=L, M, and H).

$$K^T = \begin{bmatrix} 2.544\times10^{-5} & 1.3089\times10^{-5} & -2.7952\times10^{-6} \\ 1.2398\times10^{-5} & 7.4411\times10^{-6} & 4.8028\times10^{-6} \\ 6.4548\times10^{-5} & 8.9819\times10^{-6} & -1.979.\times10^{-5} \\ 2.2414\times10^{-5} & 4.2026\times10^{-7} & -3.9476.\times10^{-6} \\ -7.4288\times10^{-5} & -1.1745\times10^{-5} & 1.308\times10^{-5} \\ -8.896\times10^{-5} & -2.0402\times10^{-6} & 3.1378\times10^{-5} \\ 4.8577 & 3.6699 & 4.5680 \end{bmatrix}$$

Formula (8) combined with the results of the curve fitting is non-linear, so linearization at an arbitrary point $P(x_0, y_0, z_0)$ is necessary for analysis of numerical values. For linearization, a Jacobian matrix defined by Formula (11) should be obtained.

Step (c) includes step 108 of obtaining KV−T=0, that is, a non-linear equation expressed by Formula (10), step 110 of calculating a Jacobian matrix J of the non-linear equation, which is expressed by Formula (11), and step 112 of combining Formula (12) obtained from the Jacobian matrix J and the non-linear equation with the measured TRC ($T_H$, $T_M$, $T_L$) data and deducing the values of x, y, and z using Newton's method.

$$\begin{bmatrix} A_L \\ A_M \\ A_H \end{bmatrix} x^2 + \begin{bmatrix} B_L \\ B_M \\ B_H \end{bmatrix} y^2 + \begin{bmatrix} C_L \\ C_M \\ C_H \end{bmatrix} z^2 + \begin{bmatrix} D_L \\ D_M \\ D_H \end{bmatrix} xy + \begin{bmatrix} E_L \\ E_M \\ E_H \end{bmatrix} yz + \begin{bmatrix} F_L \\ F_M \\ F_H \end{bmatrix} zx + \begin{bmatrix} G_L - T_L \\ G_M - T_M \\ G_H - T_H \end{bmatrix} = \begin{bmatrix} 0 \\ 0 \\ 0 \end{bmatrix} \tag{10}$$

$$J = \begin{bmatrix} \frac{\partial T_L}{\partial x} & \frac{\partial T_L}{\partial y} & \frac{\partial T_L}{\partial z} \\ \frac{\partial T_M}{\partial x} & \frac{\partial T_M}{\partial y} & \frac{\partial T_M}{\partial z} \\ \frac{\partial T_H}{\partial x} & \frac{\partial T_H}{\partial y} & \frac{\partial T_H}{\partial z} \end{bmatrix} = \begin{bmatrix} J_{11} & J_{12} & J_{13} \\ J_{21} & J_{22} & J_{23} \\ J_{31} & J_{32} & J_{33} \end{bmatrix} \tag{11}$$

$$J_{11}=2A_Lx+D_Ly+F_Lz,\ J_{12}=D_Lx+2B_Ly+E_Lz,\ J_{13}=F_Lx+E_Ly+2C_Lz$$

$$J_{21}=2A_Mx+D_My+F_Mz,\ J_{22}=D_Mx+2B_My+E_Mz,\ J_{23}=F_Mx+E_My+2C_Mz$$

$$J_{31}=2A_Hx+D_Hy+F_Hz,\ J_{32}=D_Hx+2B_Hy+E_Hz,\ J_{33}=F_Hx+E_Hy+2C_Hz$$

$$\begin{bmatrix} x^{(k)} \\ y^{(k)} \\ z^{(k)} \end{bmatrix} = \begin{bmatrix} x^{(k-1)} \\ y^{(k-1)} \\ z^{(k-1)} \end{bmatrix} - (j(x^{(k-1)}, y^{(k-1)}, z^{(k-1)}))^{-1} (KV - T)(x^{(k-1)}, y^{(k-1)}, z^{(k-1)}) \tag{12}$$

Newton's method is used to approximate the solution of a non-linear system, F(x)=0, given an initial approximation "x". When n number of equations and unknowns, an initial approximation $x=(x_1, \ldots, x_n)^t$, a tolerance TOL, and a maximum number of iterations N are given as input values, an approximate solution $x=(x_1, \ldots, x_n)^t$ or a message that the number of iterations is reached is output. Newton's method is performed as follows.

In a first step, k=1 is set. In a second step, third through seventh steps are repeated when $k \leqq N$. In the third step, F(x) and J(x) (where $J(x)_{ij}=(\partial f_i(x)/\partial x_j)$ for $1 \leqq i,j \leqq n$) are calculated. Ip the fourth step, the n×n linear system J(x)y=−F(x) is solved. In the fifth step, x=x+y is set. In the sixth step, "x" is output if ||y||<TOL. In the seventh step, k=k+1 is set when ||y||>TOL. In an eighth step, "Maximum number of iterations is reached" is output.

In the TRC control method according to the embodiment of the present invention, F(x)=(KV−T)(x), and x, y, and z linearly corresponding to CTD sensor values $T_L$, $T_M$, and $T_H$ can be obtained by applying Newton's method to the non-linear equation of Formula (12). When a value deduced through such an arrangement does not exceed a nominal value and a predetermined threshold value, the x, y, and z constitute an RTRC($T_{RH}$, $T_{RM}$, $T_{RL}$). "RTCR" (reference RTC) is the standard value of TRC obtained after many experiments.

In the TRC control method according to the embodiment, only a CTD sensor is used. If an electrostatic sensor and a developer development current Id measuring sensor are used, it is not necessary to deduce the charging potential $V_O$, the exposure potential $V_R$, and the development current Id. However, it is nearly impossible to install the electrostatic sensor and the developer development current Id measuring sensor within an electrophotographic printer. Accordingly, the TRC control method according to the embodiment of the present invention deduces the charging potential $V_O$, the exposure potential $V_R$, and the development current Id using only the CTD sensor.

In order to control the TRC as described above, the TRC control method according to the embodiment includes detecting the quantity of light reflected from test patches having different toner area coverages on a photoreceptor belt using a CTD sensor and deducing a development vector $V_D$, a backplating vector $V_{BP}$, and a development current Id based on the detected outputs $T_{RH}$, $T_{RM}$, and $T_{RL}$ of the CTD sensor. A development potential $V_B$ and a grid potential $V_G$ are controlled based on the deduced values of the development vector $V_D$, backplating vector $V_{BP}$, and development current Id.

In step (d), an RTRC space is formed. Step (d) includes steps 114, 116, and 118.

In step 114, the development vector $V_D$, the backplating vector $V_{BP}$, and the development current Id are deduced by combining the TRC($T_H$, $T_M$, $T_L$) data measured in step 104 with the TRC characteristic function obtained in step 108. In step 116, an RTRC($T_{RH}$, $T_{RM}$, $T_{RL}$) space is formed using TRC($T_H$, $T_M$, $T_L$) data, whose covariance is smaller than the threshold value, among the TRC($T_H$, $T_M$, $T_L$) data measured in step 104. In step 118, a function having the development current Id as an independent parameter and the development vector $V_D$ as a dependent parameter and a function having the development current Id as an independent parameter and the backplating vector $V_{BP}$ as a dependent parameter are determined by curve fitting the development vector $V_D$, the backplating vector $V_{BP}$, and the development current Id to be suitable to the RTRC($T_{RH}$, $T_{RM}$, $T_{RL}$) space formed in step 116.

In step 116, the RTRC($T_{RH}$, $T_{RM}$, $T_{RL}$) space is formed using TRC($T_H$, $T_M$, $T_L$) data obtained based on the TRC($T_H$, $T_M$, $T_L$) data measured in step 104 so as to satisfy Formula (13). In Formula (13), "e" denotes the covariance of the TRC($T_H$, $T_M$, $T_L$) data satisfying Formula (13) and is smaller than the threshold value.

$$e=(T_L-T_{RL})^2+(T_M-T_{RM})^2+(T_H-T_{RH})^2 \tag{13}$$

In step 118, functions are obtained by curve fitting the development vector $V_D$ (=x) and the backplating vector $V_{BP}$ (=y) with respect to the development current Id (=z). The functions satisfy Formula (14).

$$x=C_D(1)z^2+C_D(2)z+C_D(3)$$
$$y=C_B(1)z^2+C_B(2)z+C_B(3) \tag{14}$$

Briefly, a TRC characteristic equation is obtained from test data of measured development potential $V_B$, charging potential $V_O$, exposure potential $V_R$, development current Id, $T_H$, $T_M$ and $T_L$. Then, the TRC($T_H$, $T_M$, $T_L$) data is deduced from the TRC characteristic equation, and an RTRC($T_{RH}$, $T_{RM}$, $T_{RL}$) is formed using TRC($T_H$, $T_M$, $T_L$) data, whose covariance is smaller than a predetermined threshold value, among the deduced TRC($T_H$, $T_M$, $T_L$) data.

With respect to the development vector $V_D$ (=x), the backplating vector $V_{BP}$ (=y), and the development current Id (=z) which satisfy the above condition, a function having the development current Id as an independent parameter and the development vector $V_D$ as a dependent parameter and a function having the development current Id as an independent parameter and the backplating vector $V_{BP}$ as a dependent parameter are determined.

Figure 5:
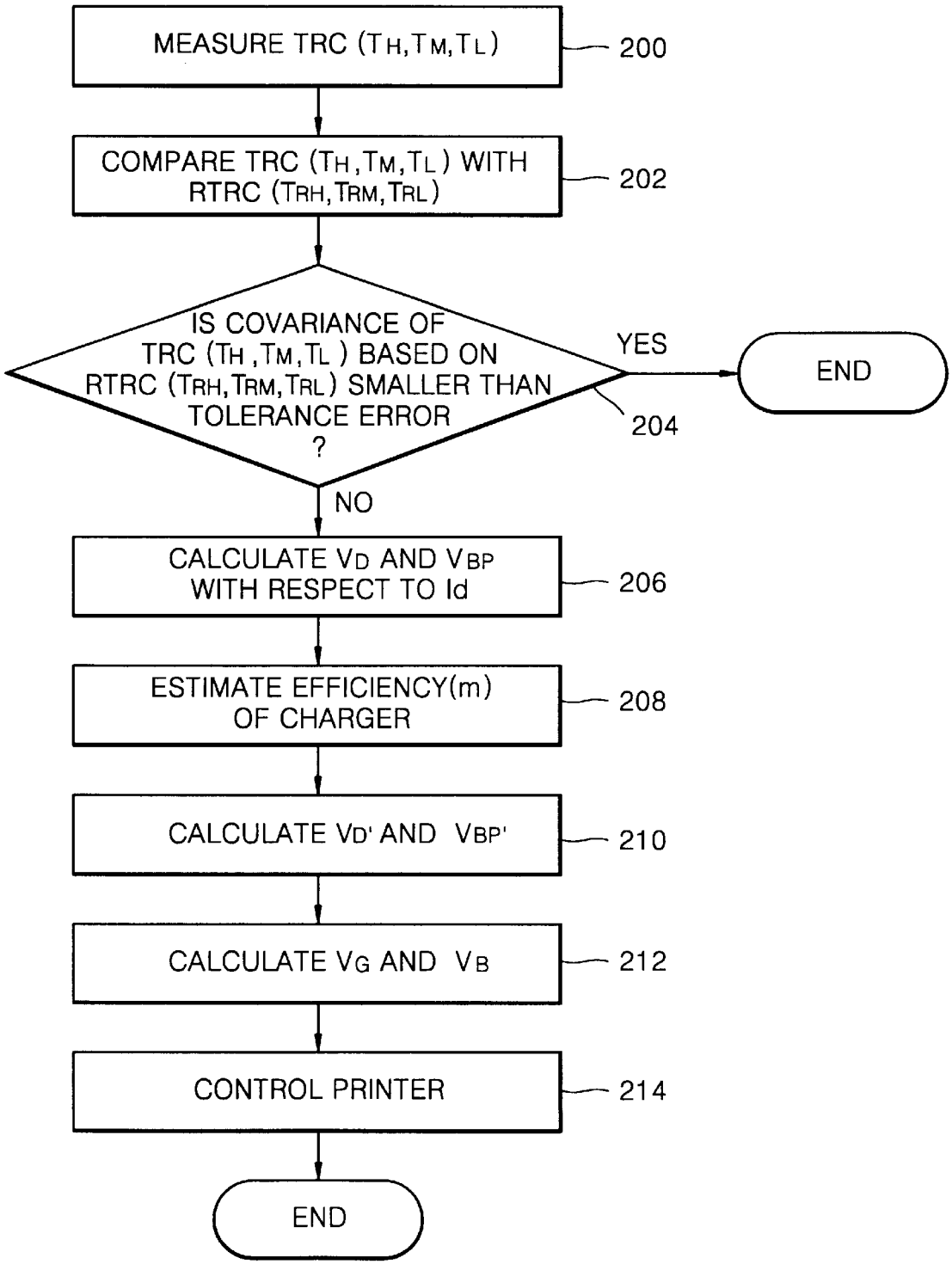
FIG. 5 is a flowchart of a TRC control method according to the embodiment of the present invention.

FIG. 5 is a flowchart of step (e) in a TRC control method according to the embodiment of the present invention. In step 200, the TRC($T_H$, $T_M$, $T_L$) data is measured in real time. In step 202, the TRC($T_H$, $T_M$, $T_L$) data is compared with the RTRC($T_{RH}$, $T_{RM}$, $T_{RL}$) data. If a covariance of the measured TRC($T_H$, $T_M$, $T_L$) data based on the RTRC($T_{RH}$, $T_{RM}$, $T_{RL}$) data is smaller than a tolerance error in step 204, the RTRC data of the printer is approximate to a target RTRC value, which means that the printer is in a normal state. Accordingly, the TRC control ends.

If a covariance of the measured TRC($T_H$, $T_M$, $T_L$) data based on the RTRC($T_{RH}$, $T_{RM}$, $T_{RL}$) data is greater than the tolerance error in step 204, in step 206 a development vector $V_D$ and a backplating vector $V_{BP}$ with respect to the measured development current Id are calculated from the TRC characteristic function obtained in step 108.

In step 208, the efficiency "m" of the charger 15 is estimated from the development vector $V_D$ and the backplating vector $V_{BP}$ calculated in step 206 and from the measured development potential $V_B$ and grid potential $V_G$.

$$V_O = V_B + V_{BP} \tag{15}$$

$$V_R = V_B - V_D \tag{16}$$

$$m = \frac{V_O}{V_G} \tag{17}$$

In step 210, a new development vector $V_D'$ and a new backplating vector $V_{BP}'$ are calculated by combining the measured development current Id (=z) with the functions of the development vector $V_D$ and the backplating vector $V_{BP}$ obtained from Formula (14).

In step 212, a grid potential $V_G$ and a development potential $V_B$, which are control parameters, are calculated by combining the new development vector $V_D'$ and the new backplating vector $V_{BP}'$ calculated in step 210 with Formulae (18) through (21).

$$V_R = \frac{a(V_D' + V_{BP}')}{1-a} + b \tag{18}$$

$$V_B = V_R + V_D' \tag{19}$$

$$V_O = V_R + V_B + V_{BP}' \tag{20}$$

$$V_G = (V_B + V_{BP}')/m \tag{21}$$

Here, "a" and "b" are the coefficients of a characteristic equation expressing the correlation between the charging potential $V_O$ and exposure potential $V_R$ of a photoreceptor belt and the power of a laser beam in a test. As a result of the test, "a" and "b" were 0.382 and −130, respectively. Since the exposure potential $V_R$ is more influenced by an initial charging potential $V_O$ of the photoreceptor belt immediately before exposure than by a change in the power of the laser beam, the exposure potential $V_R$ can be controlled by adjusting the grid potential $V_G$ influencing the charging potential $V_O$.

In step 214, the charging potential $V_O$, exposure potential $V_R$ and development current Id of the printer are adjusted by applying the grid potential $V_G$ and the development potential $V_B$ which are control parameters calculated from Formulae (18) through (21). By applying the grid potential $V_G$ and the development potential $V_B$, a TRC approximating an RTRC can be obtained with respect to a changed development current Id.

A TRC control method according to the embodiment of the present invention is characterized by an algorithm created by considering changes in the charging characteristics of a photosensitive body and in the characteristics of a developer. The changes are caused by internal and external environmental changes.

Additionally, in a TRC control method according to the embodiment of the present invention, a development vector $V_D$, a backplating vector $V_{BP}$, and a development current Id instead of a grid potential, a laser beam power, and a development potential are selected as internal process parameters. By selecting the values of these internal process parameters, the charging potential, exposure potential and development potential of the photosensitive body, which vary with changes in an external environment such as time and temperature and internal environmental changes, can be deduced, and the performance of a charger can be estimated. Also, a state of the photosensitive body and developer can be evaluated, thereby allowing a user to know when the photosensitive body or developer should be replaced.

In a TRC control method according to the embodiment of the present invention, a characteristic function can be obtained using TRC space data and RTRC space data which are set initially in a test, so productivity of development of the present invention is more excellent than a conventional method requiring creation of Jacobian matrixes for individual nominal values and a look-up table for the Jacobian matrixes.

In addition, according to a TRC control method according to the embodiment of the present invention, the charging potential of the photosensitive body can be estimated without using an electrostatic sensor.

As described above, a TRC control method according to the present invention has advantages of measuring TRC data using only a CTD sensor and allowing TRC control to be performed considering environmental changes by forming TRC and RTRC spaces using a TRC characteristic equation having a development vector, a backplating vector, and a development current as parameters and by deducing the TRC space data and the RTRC space data. In the present invention, a single TRC space and a single RTRC space which are obtained through a test are sufficient for TRC control, which makes immediate control possible. In addition, according to the present invention, the efficiency of a charger can be estimated from a charging potential deduced from the measured TRC data and a measured grid potential, and the characteristics of a photosensitive body and a developer can be estimated, thereby allowing a user to know when the photosensitive body and the developer should be replaced.

While this invention has been particularly shown and described with reference to preferred embodiments thereof, it will be understood by those skilled in the art that various changes in form and details may be made therein. Particularly, it is anticipated that those skilled in the art can obtain the coefficients of a characteristic equation by adjusting the levels of input and output values depending on a printer in order to obtain a TRC characteristic equation in a test. Therefore, the true scope of the invention will be defined by the appended claims.

What is claimed is:

1. A method of controlling a tone reproduction curve (TRC) in a printer including a color toner density (CTD) sensor receiving light reflected from test patches having different densities and photoelectrically converting the received light, the test patches being provided on a photoreceptor belt, the method comprising the steps of:

(a) measuring a development potential $V_B$, a charging potential $V_O$, an exposure potential $V_R$, and a development current Id and evaluating a development vector $V_D$, which is the difference between the development potential $V_B$ and the exposure potential $V_R$, and a backplating vector $V_{BP}$, which is the difference between the charging potential $V_O$ and the exposure potential $V_R$;

(b) forming a TRC space using TRC data detected from the CTD sensor;

(c) obtaining a TRC characteristic function from the TRC data, the development vector $V_D$=x, the backplating vector $V_{BP}$=y, and the development current Id=z;

(d) forming an RTRC by setting TRC data, whose covariance is smaller than a threshold value among the detected TRC data, as RTRC data; and (e) measuring TRC data, comparing the measured TRC data with the RTRC data to calculate control parameter values, and controlling the printer using the control parameter values.

2. The method of claim 1, wherein the step (a) comprises the steps of:

(a-1) measuring the development potential $V_B$, the charging potential $V_O$, the exposure potential $V_R$, and the development current Id; and (a-2) evaluating the development vector $V_D$ and the backplating vector $V_{BP}$ from the measured development potential $V_B$, the charging potential $V_O$ and the exposure potential $V_R$, and the development vector $V_D$ and the backplating vector $V_{BP}$ satisfy the following:

$$V_D=V_B-V_R$$

$$V_{BP}=V_O-V_B.$$

3. The method of claim 2, wherein the step (b) comprises the steps of:

(b-1) developing a test patch at a high toner area coverage, a test patch at a mid toner area coverage, and a test patch at a low toner area coverage on the photoreceptor belt and detecting a signal $T_H$ corresponding to the high toner area coverage, a signal $T_M$ corresponding to the mid toner area coverage, and a signal $T_L$ corresponding to the low toner area coverage from the CTD sensor receiving infrared rays reflected from the test patches and generating electrical signals; and (b-2) forming the TRC space using the detected signals $T_H$, $T_M$, and $T_L$.

4. The method of claim 3, wherein the TRC characteristic function obtained in step (c) is T=KV and satisfies the following:

$$T=\begin{bmatrix} T_L \\ T_M \\ T_H \end{bmatrix}$$

$$K=\begin{bmatrix} A_L & B_L & C_L & D_L & E_L & F_L & G_L \\ A_M & B_M & C_M & D_M & E_M & F_M & G_M \\ A_H & B_H & C_H & D_H & E_H & F_H & G_H \end{bmatrix}$$

-continued $$V=\begin{bmatrix} x^2 \\ y^2 \\ z^2 \\ xy \\ yz \\ zx \\ 1 \end{bmatrix}$$

$$x=V_D,\ y=V_{BP},\ z=Id.$$

5. The method of claim 4, wherein the step (c) comprises the steps of:

(c-1) obtaining the following non-linear equation satisfying KV−T=0

$$\begin{bmatrix} A_L \\ A_M \\ A_H \end{bmatrix}x^2+\begin{bmatrix} B_L \\ B_M \\ B_H \end{bmatrix}y^2+\begin{bmatrix} C_L \\ C_M \\ C_H \end{bmatrix}z^2+\begin{bmatrix} D_L \\ D_M \\ D_H \end{bmatrix}xy+\begin{bmatrix} E_L \\ E_M \\ E_H \end{bmatrix}yz+\begin{bmatrix} F_L \\ F_M \\ F_H \end{bmatrix}zx+\begin{bmatrix} G_L-T_L \\ G_M-T_M \\ G_H-T_H \end{bmatrix}=\begin{bmatrix} 0 \\ 0 \\ 0 \end{bmatrix};$$

(c-2) obtaining a Jacobian matrix J of the non-linear equation as follows $$J=\begin{bmatrix} \frac{\partial T_L}{\partial x} & \frac{\partial T_L}{\partial y} & \frac{\partial T_L}{\partial z} \\ \frac{\partial T_M}{\partial x} & \frac{\partial T_M}{\partial y} & \frac{\partial T_M}{\partial z} \\ \frac{\partial T_H}{\partial x} & \frac{\partial T_H}{\partial y} & \frac{\partial T_H}{\partial z} \end{bmatrix}=\begin{bmatrix} J_{11} & J_{12} & J_{13} \\ J_{21} & J_{22} & J_{23} \\ J_{31} & J_{32} & J_{33} \end{bmatrix}$$

in which $$J_{11}=2A_Lx+D_Ly+F_Lz,\ J_{12}=D_Lx+2B_Ly+E_Lz,\ J_{13}=F_Lx+E_Ly+2C_Lz$$
$$J_{21}=2A_Mx+D_My+F_Mz,\ J_{22}=D_Mx+2B_My+E_Mz,\ J_{23}=F_Mx+E_My+2C_Mz$$
$$J_{31}=2A_Hx+D_Hy+F_Hz,\ J_{32}=D_Hx+2B_Hy+E_Hz,\ J_{33}=F_Hx+E_Hy+2C_Hz;$$

(c-3) deducing the values of x, y, and z by combining the following equation obtained from the Jacobian matrix J and the non-linear equation with the detected TRC ($T_H$, $T_M$, $T_L$) data $$\begin{bmatrix} x^{(k)} \\ y^{(k)} \\ z^{(k)} \end{bmatrix}=\begin{bmatrix} x^{(k-1)} \\ y^{(k-1)} \\ z^{(k-1)} \end{bmatrix}-(j(x^{(k-1)},\ y^{(k-1)},\ z^{(k-1)}))^{-1}(KV-T)(x^{(k-1)},\ y^{(k-1)},\ z^{(k-1)}).$$

6. The method of claim 5, wherein the step (d) comprises the steps of:

(d-1) deducing the development vector $V_D$, the backplating vector $V_{BP}$, and the development current Id by combining the TRC($T_H$, $T_M$, $T_L$) data detected in step (b-1) with the TRC characteristic function obtained in step (c);

(d-2) forming the RTRC($T_{RH}$, $T_{RM}$, $T_{RL}$) space using TRC($T_H$, $T_M$, $T_L$) data, whose covariance is smaller than the threshold value, among the TRC($T_H$, $T_M$, $T_L$) data detected in step (b-1); and (d-3) determining a function having the development current Id as an independent parameter and the development vector $V_D$ as a dependent parameter and a function having the development current Id as an independent parameter and the backplating vector $V_{BP}$ as a dependent parameter by curve fitting the development vector $V_D$, the backplating vector $V_{BP}$, and the development current Id to be suitable to the RTRC ($T_{RH}$, $T_{RM}$, $T_{RL}$) space formed in step (d-2).

7. The method of claim 6, wherein in step (d-2), the TRC($T_H$, $T_M$, $T_L$) data used for forming the RTRC($T_{RH}$, $T_{RM}$, $T_{RL}$) space satisfies the following equation so that the covariance "e" of the TRC($T_H$, $T_M$, $T_L$) data used for forming the RTRC($T_{RH}$, $T_{RM}$, $T_{RL}$) space among the TRC ($T_H$, $T_M$, $T_L$) data detected in step (b-1) is smaller than the threshold value:

$$e=(T_L-T_{RL})^2+(T_M-T_{RM})^2+(T_H-T_{RH})^2.$$

8. The method of claim 6, wherein in step (d-3), the function having the development current Id as an independent parameter and the development vector $V_D$ as a dependent parameter and the function having the development current Id as an independent parameter and the backplating vector $V_{BP}$ as a dependent parameter satisfy the following equations:

$$x=C_D(1)z^2+C_D(2)Z+C_D(3)$$

$$y=C_B(1)z^2+C_B(2)Z+C_B(3).$$

9. The method of claim 7, wherein in step (d-3), the function having the development current Id as an independent parameter and the development vector $V_D$ as a dependent parameter and the function having the development current Id as an independent parameter and the backplating vector $V_{BP}$ as a dependent parameter satisfy the following equations:

$$x=C_D(1)z^2+C_D(2)Z+C_D(3)$$

$$y=C_B(1)z^2+C_B(2)Z+C_B(3).$$

10. The method of claim 8, wherein the step (e) comprises the steps of:

(e-1) measuring the TRC($T_H$, $T_M$, $T_L$) data in real time;

(e-2) comparing the measured TRC($T_H$, $T_M$, $T_L$) data with RTRC($T_{RH}$, $T_{RM}$, $T_{RL}$) data;

(e-3) calculating the development vector $V_D$ and the backplating vector $V_{BP}$ with respect to the measured development current Id from the TRC characteristic function obtained in seep (c), when the deviation between the measured TRC($T_H$, $T_M$, $T_L$) data and the RTRC($T_{RH}$, $T_{RM}$, $T_{RL}$) data is greater than a tolerance error;

(e-4) calculating a new development vector $V_D$' and a new backplating vector $V_{BP}$' by combining the measured development current Id with the functions of the development vector $V_D$ and the backplating vector $V_{BP}$ obtained in step (d-3);

(e-5) calculating a value of a grid potential $V_G$ and a value of the development potential $V_B$ as the control parameter values using the new development vector $V_D$' and the new backplating vector $V_{BP}$' calculated in step (e-4); and (e-6) controlling the charging potential $V_O$, the exposure potential $V_R$ and the development current Id of the printer by applying the value of the grid potential $V_G$ and the value of the development potential $V_B$ to the printer.

11. The method of claim 9, wherein the step (e) comprises the steps of:

(e-1) measuring the TRC($T_H$, $T_M$, $T_L$) data in real time;

(e-2) comparing the measured TRC($T_H$, $T_M$, $T_L$) data with the RTRC($T_{RH}$, $T_{RM}$, $T_{RL}$) data;

(e-3) calculating the development vector $V_D$ and the backplating vector $V_{BP}$ with respect to the measured development current Id from the TRC characteristic function obtained in step (c), when the deviation between the measured TRC($T_H$, $T_M$, $T_L$) data and the RTRC($T_{RH}$, $T_{RM}$, $T_{RL}$) data is greater than a tolerance error;

(e-4) calculating a new development vector $V_D$' and a new backplating vector $V_{BP}$' by combining the measured development current Id with the functions of the development vector $V_D$ and the backplating vector $V_{BP}$ obtained in step (d-3);

(e-5) calculating a value of a grid potential $V_G$ and a value of the development potential $V_B$ as the control parameter values using the new development vector $V_D$' and the new backplating vector $V_{BP}$' calculated in step (e-4); and (e-6) controlling the charging potential $V_O$, the exposure potential $V_R$ and the development current Id of the printer by applying the value of the grid potential $V_G$ and the value of the development potential $V_B$ to the printer.

12. The method of claim 8, wherein the step (e) further comprises the step of (e-7) estimating the efficiency of a charger from the development vector $V_D$ and the backplating vector $V_{BP}$ which are calculated in step (e-3) and from the development potential $V_B$ and a grid potential $V_G$ which are measured.

13. The method of claim 9, wherein the step (e) further comprises the step of (e-7) estimating the efficiency of a charger from the development vector $V_D$ and the backplating vector $V_{BP}$ which are calculated in step (e-3) and from the development potential $V_B$ and a grid potential $V_G$ which are measured.

14. The method of claim 10, wherein the step (e) further comprises the step of (e-7) estimating the efficiency of a charger from the development vector $V_D$ and the backplating vector $V_{BP}$ which are calculated in step (e-3) and from the development potential $V_B$ and the grid potential $V_G$ which are measured.

15. The method of claim 11, wherein the step (e) further comprises the step of (e-7) estimating the efficiency of a charger from the development vector $V_D$ and the backplating vector $V_{BP}$ which are calculated in step (e-3) and from the development potential $V_B$ and the grid potential $V_G$ which are measured.

16. The method of claim 12, wherein the step (e-7) comprises the steps of:

(e-7-1) calculating the charging potential $V_O$ and the exposure potential $V_R$ from the development vector $V_D$, the backplating vector $V_{BP}$, the development potential $V_B$, and the grid potential $V_G$ according to $$V_O=V_B+V_{BP}$$

$$V_R=V_B-V_D;\text{ and}$$

(e-7-2) calculating the efficiency "m" of the charger from the charging potential $V_O$ and the exposure potential $V_R$ according to $$m = \frac{V_O}{V_G}.$$

17. The method of claim 13, wherein the step (e-7) comprises the steps of:

(e-7-1) calculating the charging potential $V_O$ and the exposure potential $V_R$ from the development vector $V_D$, the backplating vector $V_{BP}$, the development potential $V_B$, and the grid potential $V_G$ according to $$V_O = V_B + V_{BP}$$

$$V_R = V_B - V_D; \text{ and}$$

(e-7-2) calculating the efficiency "m" of the charger from the charging potential $V_O$ and the exposure potential $V_R$ according to $$m = \frac{V_O}{V_G}.$$

18. The method of claim 14, wherein the step (e-7) comprises the steps of:

(e-7-1) calculating the charging potential $V_O$ and the exposure potential $V_R$ from the development vector $V_D$, the backplating vector $V_{BP}$, the development potential $V_B$, and the grid potential $V_G$ according to $$V_O = V_B + V_{BP}$$

$$V_R = V_B - V_D; \text{ and}$$

(e-7-2) calculating the efficiency "m" of the charger from the charging potential $V_O$ and the exposure potential $V_R$ according to $$m = \frac{V_O}{V_G}.$$

19. The method of claim 15, wherein the step (e-7) comprises the steps of:

(e-7-1) calculating the charging potential $V_O$ and the exposure potential $V_R$ from the development vector $V_D$, the backplating vector $V_{BP}$, the development potential $V_B$, and the grid potential $V_G$ according to $$V_O = V_B + V_{BP}$$

$$V_R = V_B - V_D; \text{ and}$$

(e-7-2) calculating the efficiency "m" of the charger from the charging potential $V_O$ and the exposure potential $V_R$ according to $$m = \frac{V_O}{V_G}.$$

20. The method of claim 10, wherein the step (e-5) comprises calculating the grid potential $V_G$ and the development potential $V_B$ as the control parameters from the new development vector $V_D'$ and the new backplating vector $V_{BP}'$, which are calculated in step (c-4), the grid potential $V_G$ and the development potential $V_B$ satisfying $$V_R = \frac{a(V_D' + V_{BP}')}{1 - a} + b$$

$$V_B = V_R + V_D'$$

$$V_O = V_R + V_B + V_{BP}'$$

$$V_G = (V_B + V_{BP}')/m.$$

21. The method of claim 11, wherein the step (e-5) comprises calculating the grid potential $V_G$ and the development potential $V_B$ as the control parameters from the new development vector $V_D'$ and the new backplating vector $V_{BP}'$, which are calculated in step (e-4), the grid potential $V_G$ and the development potential $V_B$ satisfying $$V_R = \frac{a(V_D' + V_{BP}')}{1 - a} + b$$

$$V_B = V_R + V_D'$$

$$V_O = V_R + V_B + V_{BP}'$$

$$V_G = (V_B + V_{BP}')/m.$$

22. The method of claim 12, wherein the step (e-5) comprises calculating the grid potential $V_G$ and the development potential $V_B$ as the control parameters from the new development vector $V_D'$ and the new backplating vector $V_{BP}'$, which are calculated in step (e-4), the grid potential $V_G$ and the development potential $V_B$ satisfying $$V_R = \frac{a(V_D' + V_{BP}')}{1 - a} + b$$

$$V_B = V_R + V_D'$$

$$V_O = V_R + V_B + V_{BP}'$$

$$V_G = (V_B + V_{BP}')/m.$$

23. The method of claim 13, wherein the step (e-5) comprises calculating a grid potential $V_G$ and a development potential $V_B$ as the control parameters from the new development vector $V_D'$ and the new backplating vector $V_{BP}'$, which are calculated in step (e-4), the grid potential $V_G$ and the development potential $V_B$ satisfying $$V_R = \frac{a(V_D' + V_{BP}')}{1 - a} + b$$

$$V_B = V_R + V_D'$$

$$V_O = V_R + V_B + V_{BP}'$$

$$V_G = (V_B + V_{BP}')/m.$$

24. The method of claim 14, wherein the step (e-5) comprises calculating the grid potential $V_G$ and the development potential $V_B$ as the control parameters from the new development vector $V_D'$ and the new backplating vector $V_{BP}'$, which are calculated in step (e-4), the grid potential $V_G$ and the development potential $V_B$ satisfying $$V_R = \frac{a(V_D' + V_{BP}')}{1 - a} + b$$

$$V_B = V_R + V_D'$$

$$V_O = V_R + V_B + V_{BP}'$$

$$V_G = (V_B + V_{BP}')/m.$$

25. The method of claim 15, wherein the step (e-5) comprises calculating the grid potential $V_G$ and the development potential $V_B$ as the control parameters from the new development vector $V_D'$ and the new backplating vector $V_{BP}'$, which are calculated in step (e-4), the grid potential $V_G$ and the development potential $V_B$ satisfying $$V_R = \frac{a(V_D' + V_{BP}')}{1 - a} + b$$

$$V_B = V_R + V_D'$$

-continued $$V_O = V_R + V_B + V_{BP}'$$

$$V_G = (V_B + V_{BP}')/m.$$

* * * * *